US006868764B1

(12) United States Patent
Dishon et al.

(10) Patent No.: US 6,868,764 B1
(45) Date of Patent: Mar. 22, 2005

(54) MATERIAL CUTTING AND FEEDING MACHINE

(76) Inventors: James T. Dishon, P.O. Box 135, Shawnee, OH (US) 43782; Anthony C. Johnson, 25223 Liberty Hill Rd., South Bloomingville, OH (US) 43152

( * ) Notice: Subject to any disclaimer, the term of this patent is extended or adjusted under 35 U.S.C. 154(b) by 0 days.

(21) Appl. No.: 09/439,332

(22) Filed: Nov. 12, 1999

(51) Int. Cl.[7] ..... B26D 5/20; B65H 35/04

(52) U.S. Cl. ..... 83/86; 83/156; 83/162; 83/167; 83/209; 83/212.1; 83/213; 83/255; 83/649; 83/678; 83/694; 83/695; 83/949

(58) Field of Search ..... 83/649, 650, 678, 83/212.1, 213, 214, 39.52, 56, 63, 76.6, 84, 86, 156, 161, 162, 167, 209, 694, 695, 949; 242/521, 522, 523, 523.1, 524, 524.1

(56) References Cited

U.S. PATENT DOCUMENTS 3,716,132 A * 2/1973 Lewyckyi ..... 83/678 X
4,207,667 A * 6/1980 D'Angelo et al. ..... 83/649 X
4,487,377 A * 12/1984 Perini ..... 242/521
4,697,755 A * 10/1987 Kataoka ..... 242/534
5,099,671 A * 3/1992 Beaulac ..... 83/649 X
5,839,688 A * 11/1998 Hertel et al. ..... 242/523.1
6,003,420 A * 12/1999 Wakabayashi et al. ..... 83/214
6,257,112 B1 * 7/2001 Wakabayashi et al. ..... 83/214

* cited by examiner

*Primary Examiner*—Clark F. Dexter

(57) ABSTRACT

A material cutting and feeding machine for cutting and perforating a roll of paper. The material cutting and feeding machine includes a generally rectangular frame. A material feeding roller is mounted to the frame. The feeding roller is adapted to hold a roll of paper. A motor is adapted to rotate a draw roller assembly that draws the paper from the paper roll. A cutting assembly is mounted adjacent to the draw roller. The cutting assembly comprises a latitudinal perforating bar adapted to perforate the paper along a width of the paper, a perforating wheel adapted to perforate a length of the paper, and a latitudinal cutting bar adapted to cut the paper along the width of the paper. A guide roller assembly comprised of four rollers and two guides is orientated to feed the paper from the paper cutter to an exit in the frame.

9 Claims, 3 Drawing Sheets

10
11
62
19
39

MATERIAL CUTTING AND FEEDING MACHINE

BACKGROUND OF THE INVENTION

1. Field of the Invention

The present invention relates to paper cutting machines and more particularly pertains to a new material cutting and feeding machine for cutting and perforating a roll of paper.

2. Description of the Prior Art

The use of paper cutting machines is known in the prior art. More specifically, paper cutting machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,235,882; U.S. Pat. No. 5,431,077; U.S. Pat. No. 3,986,419; U.S. Pat. No. 4,907,014; U.S. Pat. Des. No. 340,067; and U.S. Pat. No. 4,293,236.

While these devices fulfill their respective, particular objectives and requirements, the aforementioned patents do not disclose a new material cutting and feeding machine. The inventive device includes a generally rectangular frame. A material feeding roller is mounted to the frame. The feeding roller is adapted to hold a roll of paper. A motor is adapted to rotate a draw roller assembly that draws the paper from the paper roll. A cutting means is mounted adjacent to the draw roller. The cutting means comprises a latitudinal perforating bar adapted to perforate the paper along a width of the paper, a perforating wheel adapted to perforate a length of the paper, and a latitudinal cutting bar adapted to cut the paper along the width of the paper. A guide roller assembly comprised of four rollers and two guides is orientated to feed the paper from the paper cutter to an exit in the frame.

In these respects, the material cutting and feeding machine according to the present invention substantially departs from the conventional concepts and designs of the prior art, and in so doing provides an apparatus primarily developed for the purpose of cutting and perforating a roll of paper.

SUMMARY OF THE INVENTION

In view of the foregoing disadvantages inherent in the known types of paper cutting machines now present in the prior art, the present invention provides a new material cutting and feeding machine construction wherein the same can be utilized for cutting and perforating a roll of paper.

The general purpose of the present invention, which will be described subsequently in greater detail, is to provide a new material cutting and feeding machine apparatus and method which has many of the advantages of the paper cutting machines mentioned heretofore and many novel features that result in a new material cutting and feeding machine which is not anticipated, rendered obvious, suggested, or even implied by any of the prior art paper cutting machines, either alone or in any combination thereof.

To attain this, the present invention generally comprises a generally rectangular frame. A material feeding roller is mounted to the frame. The feeding roller is adapted to hold a roll of paper. A motor is adapted to rotate a draw roller assembly that draws the paper from the paper roll. A cutting means is mounted adjacent to the draw roller. The cutting means comprises a latitudinal perforating bar adapted to perforate the paper along a width of the paper, a perforating wheel adapted to perforate a length of the paper, and a latitudinal cutting bar adapted to cut the paper along the width of the paper. A guide roller assembly comprised of four rollers and two guides is orientated to feed the paper from the paper cutter to an exit in the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new material cutting and feeding machine apparatus and method which has many of the advantages of the paper cutting machines mentioned heretofore and many novel features that result in a new material cutting and feeding machine which is not anticipated, rendered obvious, suggested, or even implied by any of the prior art paper cutting machines, either alone or in any combination thereof.

It is another object of the present invention to provide a new material cutting and feeding machine which may be easily and efficiently manufactured and marketed.

It is a further object of the present invention to provide a new material cutting and feeding machine which is of a durable and reliable construction.

An even further object of the present invention is to provide a new material cutting and feeding machine which is susceptible of a low cost of manufacture with regard to both materials and labor, and which accordingly is then susceptible of low prices of sale to the consuming public, thereby making such material cutting and feeding machine economically available to the buying public.

Still yet another object of the present invention is to provide a new material cutting and feeding machine which provides in the apparatuses and methods of the prior art some of the advantages thereof, while simultaneously overcoming some of the disadvantages normally associated therewith.

Still another object of the present invention is to provide a new material cutting and feeding machine for cutting and perforating a roll of paper.

Yet another object of the present invention is to provide a new material cutting and feeding machine which includes a generally rectangular frame. A material feeding roller is mounted to the frame. The feeding roller is adapted to hold a roll of paper. A motor is adapted to rotate a draw roller assembly that draws the paper from the paper roll. A cutting means is mounted adjacent to the draw roller. The cutting means comprises a latitudinal perforating bar adapted to perforate the paper along a width of the paper, a perforating wheel adapted to perforate a length of the paper, and a latitudinal cutting bar adapted to cut the paper along the width of the paper. A guide roller assembly comprised of four rollers and two guides is orientated to feed the paper from the paper cutter to an exit in the frame.

Still yet another object of the present invention is to provide a new material cutting and feeding machine that will allow users to use rolls of paper which can be cut down into pieces of paper smaller than a standard sheet to save on resources.

Even still another object of the present invention is to provide a new material cutting and feeding machine that will perforate the paper both along a width and a length. The ability to perforate the paper allows the user multiple uses such as creation of billing statements from regular stock paper.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
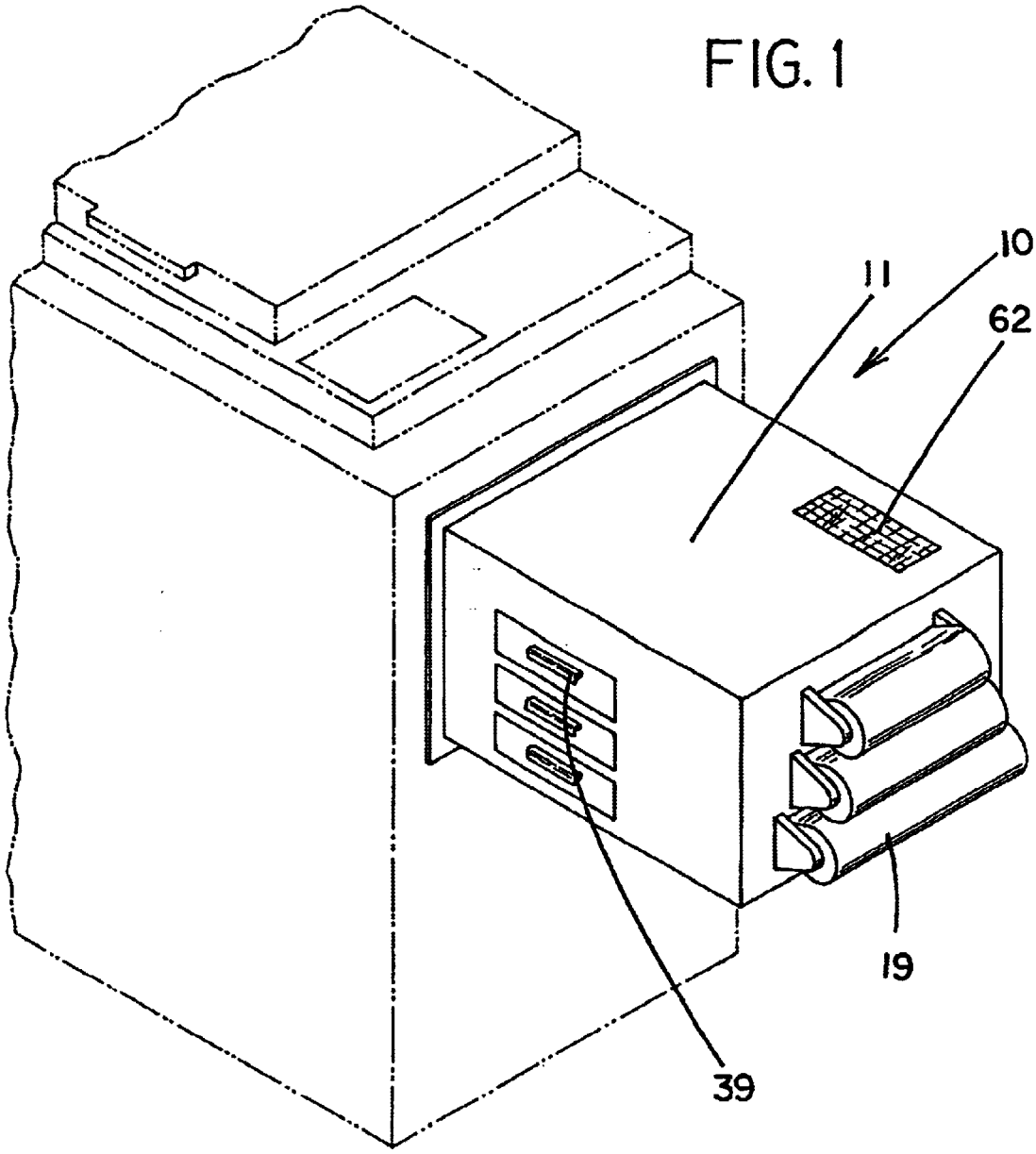
FIG. 1 is a schematic perspective view of a new material cutting and feeding machine according to the present invention.
Figure 2:
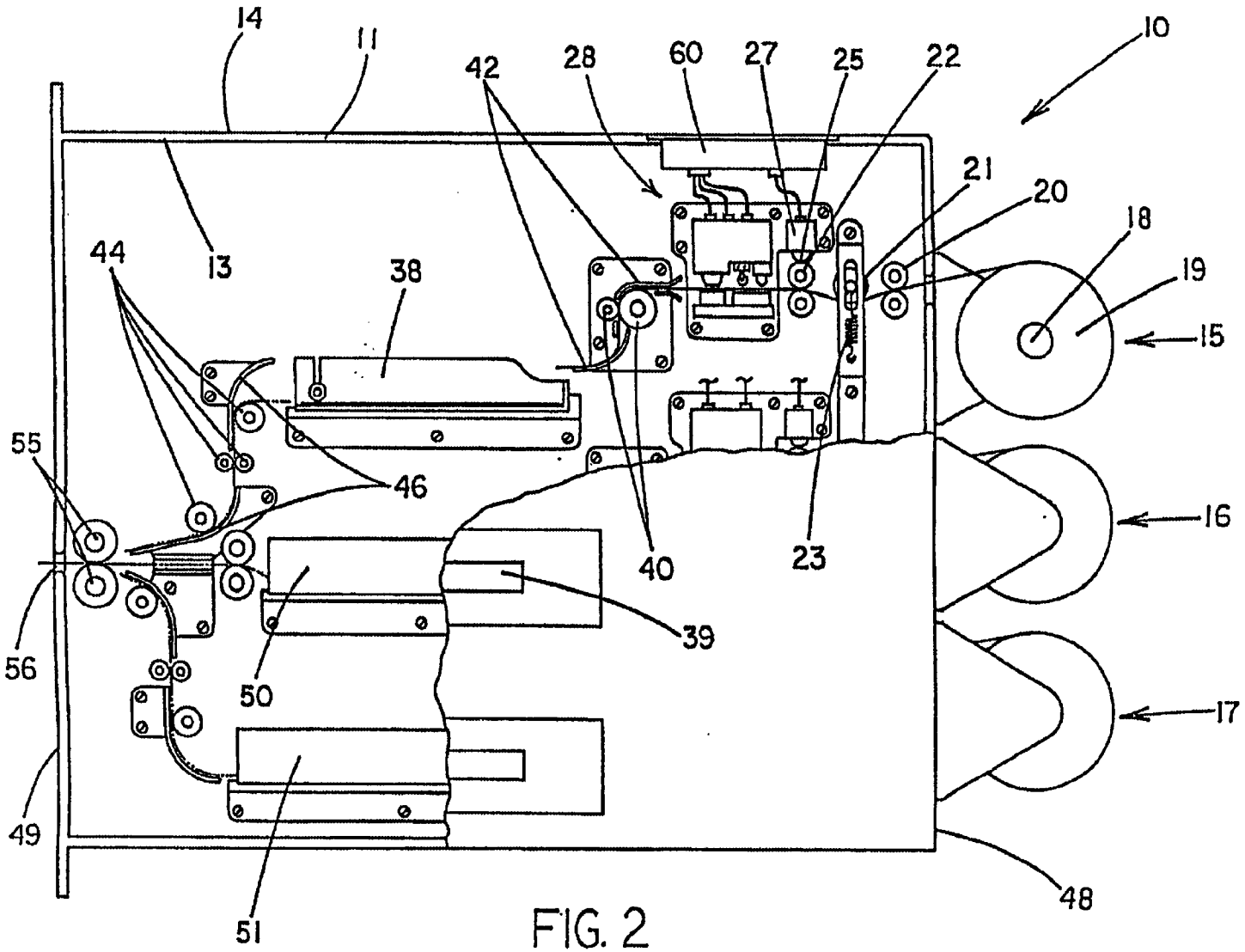
FIG. 2 is a schematic side view of the present invention.
Figure 3:
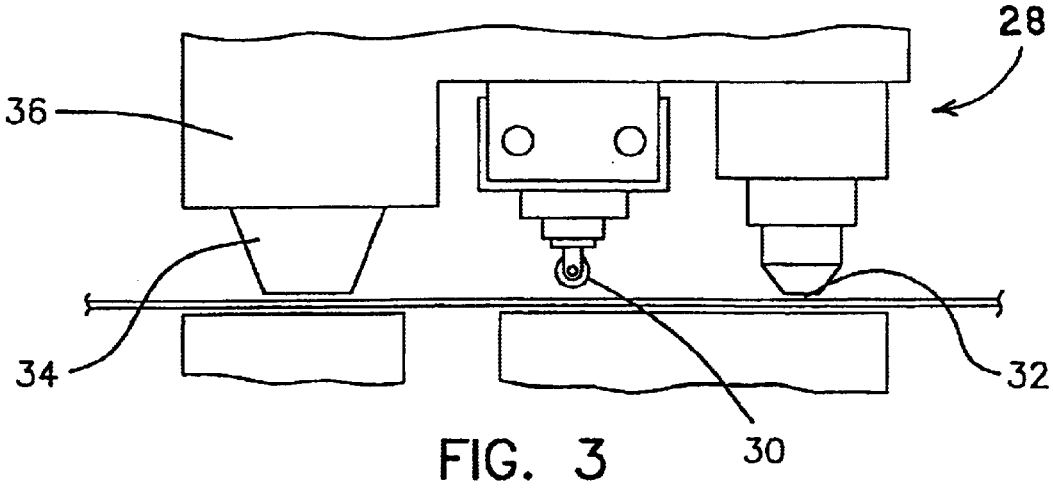
FIG. 3 is a schematic expanded view of the cutting mechanism of the present invention.
Figure 4:
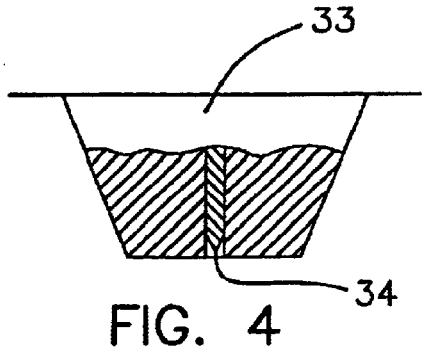
FIG. 4 is a schematic cross-section view of the cutting blade of the present invention.
Figure 5:
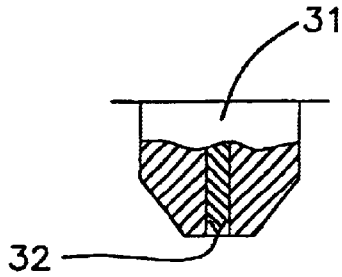
FIG. 5 is a schematic cross-section view the perforating blade of the present invention.
Figure 6:
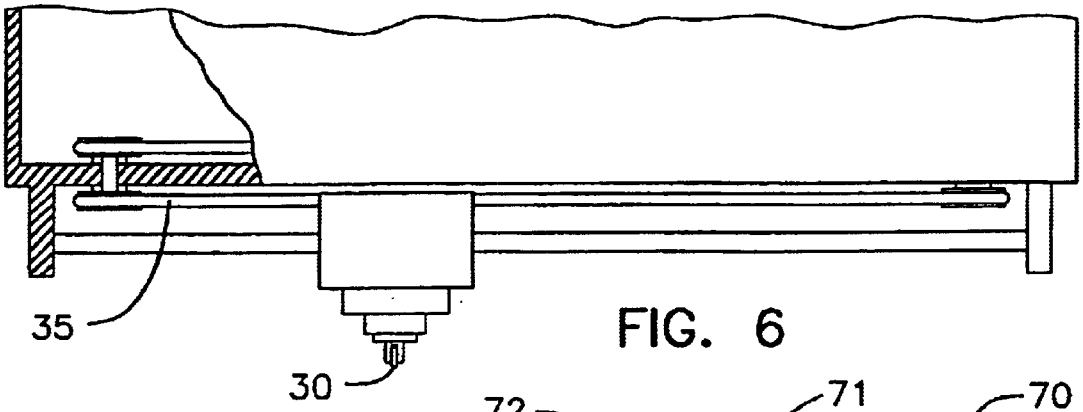
FIG. 6 is a schematic front view of the perforating wheel of the present invention.

With reference now to the drawings, and in particular to FIGS. 1 through 7 thereof, a new material cutting and feeding machine embodying the principles and concepts of the present invention and generally designated by the reference numeral 10 will be described.

As best illustrated in FIGS. 1 through 7, the material cutting and feeding machine 10 generally comprises a rectangular frame 11 wherein the frame has an inside portion 13 and an outside portion 14. The frame supports a first 15, second 16 and third 17 paper cutting and delivering means.

The first paper cutting and delivering means comprises a material feeding roller means 18 wherein the roller means is attached to the outside portion of the frame. The feeding roller means is adapted to feed a continuous roll of paper 19 into the frame such that the paper is horizontal to the floor.

Preferably, a pressing means is mounted to the inside of the frame wherein the pressing means is adapted to flatten the paper. Pressing the paper allows it to travel smoother through a cutting apparatus without the edges of the paper curling. The pressing means is adjacent to the feeding means. The pressing means is comprised of a first draw roller assembly 20, a tension roller 21 and a second draw roller assembly 22. The tension roller has a spring 23 attached thereto adapted to apply downward tension on the tension roller. The first and the second draw roller assemblies are comprised of two rollers. Preferably, the second draw roller is in fluid connection with a sensor 25. The sensor rotates the second draw roller to pull the paper into the frame. The sensor is adapted to measure a length of the paper for cutting purposes. The machine can be set up with only one draw roller assembly which can pull the paper into the machine. Also, the sensor is optional as the machine can be adapted to use a standard length of paper for cutting purposes.

A motor 27 is preferably rotationally coupled to the sensor means. The motor rotates the sensor means. If a sensor means is not used, then the motor is coupled to one of the draw rollers directly.

A cutting means 28 is mounted adjacent to the second draw roller 22. The cutting means comprises a longitudinal perforating wheel 30 adapted to perforate the paper along a length of the paper, a latitudinal perforating bar 32 adapted to perforate the paper along a width of the paper, and a latitudinal cutting bar 34 adapted to cut the paper along the width of the paper. Ideally, all three cutters are included, however, only the cutting bar is required. All three sit in a casing 36. The casing has two sub-casings 31, 33 which lift up the bar cutters when they are not being used and engages the cutters when cutting is required. The perforating wheel is attached to a belt 35 which pulls the wheel to the left-or right depending on where the user would like vertical perforations in the page. In another embodiment, not shown, a plurality of perforation wheels are used.

A paper holder 38 is mounted in the frame. The paper holder is slidably mounting into the frame so that the paper holder can be accessed by pulling the paper holder from the frame. The paper holder has a handle 39 to pull the holder out with.

A first guide roller assembly mounted between the cutting means and the paper holder comprises two rollers 40 and two guide 42 bars adapted to direct the paper into the paper holder.

A second guide roller assembly comprised of four rollers 44 and two guides 46 is adapted to feed the paper from the paper holder to an exit in the frame.

The second 16 and the third 17 paper cutting and delivery means are substantially identical to the first paper cutting and delivery means. The second means is mounted below the first means, and the third means is mounted below the second means whereby all three cutting and delivery means are mounted parallel to each other and all direct paper from a first end 48 of the frame to a second end 49 of the frame. Preferably, the paper holder 50 of the second means is larger than the paper holder 38 of the first means. A paper holder 51 of the third means is larger than the paper holder of the second means 50.

The exit in the frame comprises two rollers 55 and an opening 56 in the frame 11. The exit is adapted to receive paper from each of the cutting and delivery means.

An actuating means 60 is operationally coupled to each of the cutting means and to each of the motor means. Preferably, the actuating means is includes a keypad 62 and is adapted to be programmable for variable cutting and perforating patterns.

All rollers depicted in the figures are cylindrical in shape. All parts can be mounted to the frame by any mounting means known in the art, however, bolts and screw work ideally as they can be removed for repair or refitting. The frame can be sized according to its use for either printers or copiers.

Figure 7:
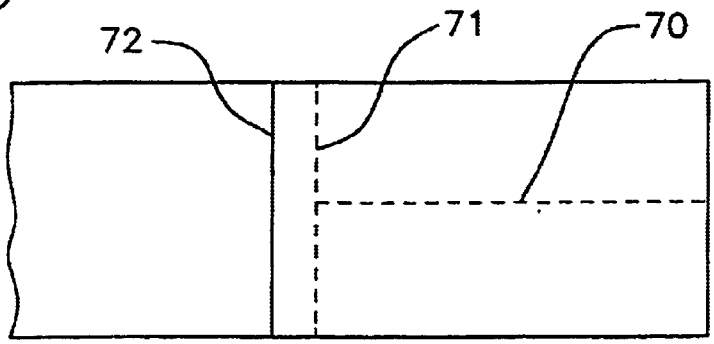
FIG. 7 is a schematic plan view of paper cut using the present invention.

In use, the user loads paper onto the feeding roller 18. Though not preferred, single sheets can be fed through the opening used by the feeding roller as the machine will still perforate and cut single sheets of paper. The paper is fed through the draw rollers 20, 22 and the tension roller 21. The second draw roller 22 rotates as the sensor 25 which is attached to it rotates. The sensor determines the length of paper to enter the frame depending on the particular program selected. As the paper is fed through the cutters, perforations and cuts are made in the paper as directed by the programmer. The paper then travels through the guide rollers 42 to the paper tray 38. This tray can store paper cut by the machine for later use, or it can be opened and precut paper can be placed into the holder. The paper next enters the next set of guide rollers 44 and is fed to the exit out the back side 49 of the frame and into a printer or copier. FIG. 7 most clearly demonstrates the result of running paper through the machine. The dashed lines indicated perforations. The dashed line 70 running in the direction of paper feeding is made with the perforation wheel. The other perforated line 71 is made with the perforation bar. The solid cut 72 is made with the cutting bar.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A machine for cutting and feeding sheet material comprising:

a frame, said frame being generally rectangular;

a paper cutting and delivering means comprising:

a material feeding roller means mounted to said frame, said feeding roller means for holding a roll of paper;

a drawing means, and a motor means for rotating said drawing means, wherein said drawing means is for drawing said paper from said paper roll;

a cutting means, said cutting means being mounted adjacent to said drawing means, said cutting means comprising a linearly reciprocable latitudinal perforating bar for perforating said paper along a width of said paper, and a linearly reciprocable latitudinal cutting bar for cutting said paper along said width of said paper;

a guide roller assembly comprised of four rollers and two guides orientated to feed said paper from said cutting means to an exit in said frame; and an actuating means operationally coupled to said cutting means and to said motor means;

wherein said frame has an inside portion and an outside portion whereby said material feeding roller means is mounted to said frame on said outside of said frame;

wherein said drawing means further comprises:

a first pair of rollers, a tension roller and a second pair of rollers, said tension roller having a spring attached thereto for applying downward tension on said tension roller wherein said second pair of rollers being rotated by said motor means.

2. The machine for cutting and feeding sheet material as stated in claim 1, wherein said paper cutting and delivery means further comprises a sensor coupled to said frame, wherein said sensor measures a length of said paper, said sensor being between said motor means and said second pair of rollers wherein said sensor is for actuating said motor means for rotating said second pair of rollers.

3. The machine for cutting and feeding sheet material as stated in claim 1, wherein said cutting means further comprises a longitudinal perforating wheel, wherein said perforating wheel perforates said paper along a length of said paper.

4. The machine for cutting and feeding sheet material as stated in claim 1, wherein said paper cutting and delivery means further comprises:

a paper holder being mounted in said frame, said paper holder being located between said cutting means and said guide roller assembly;

a second guide roller assembly mounted between said cutting means and said paper holder, said second guide roller assembly comprising two rollers and two guide bars for directing said paper into said paper holder.

5. The machine for cutting and feeding sheet material as stated in claim 4 wherein said paper holder is slidably mounted into said frame wherein said paper holder can be accessed by pulling said paper holder from said frame.

6. The machine for cutting and feeding sheet material as stated in claim 1, wherein said frame further contains a second and a third paper cutting and delivery means being substantially identical as said first paper cutting and delivery means, said second means being mounted below said first means, said third means being mounted below said second means whereby all three cutting and delivery means are mounted parallel to each other and all direct paper from a first end of said frame to a second end of said frame.

7. The machine for cutting and feeding sheet material as stated in claim 6, wherein said first paper cutting and delivery means is adapted to hold paper of a different width than said second and third paper cutting and delivering means, said second paper cutting and delivery means being adapted to hold paper of a different width than said third paper cutting and feeding means.

8. The machine for cutting and feeding sheet material as stated in claim 1, wherein said actuating means is adapted to be programmable for variable cutting and perforating patterns.

9. A machine for cutting and feeding sheet material comprising:

a frame, said frame being generally rectangular wherein said frame has an inside portion and an outside portion;

a paper cutting and delivering means comprising:

a material feeding roller means wherein said roller means is attached to the outside portion of said frame, said feeding roller means being for feeding a continuous roll of paper into said frame such that said paper is horizontal to a floor;

a drawing means mounted to said inside of said frame wherein said drawing means flattens said paper, said drawing means being adjacent to said feeding roller means, said drawing means being comprised of a first draw roller assembly, a tension roller and a second draw roller assembly, said tension roller having a spring attached thereto for applying downward tension on said tension roller, said first and said second draw roller assemblies being comprised of two rollers, said second draw roller assembly being in fluid connection with a sensor whereby said sensor rotates said second draw roller to pull said paper into said frame wherein said sensor measures a length of said paper;

a motor means rotationally coupled to said sensor, said motor means for rotating said sensor;

a cutting means, said cutting means being mounted adjacent to said second draw roller assembly, said cutting means comprising a longitudinal perforating wheel, a linearly reciprocable latitudinal perforating bar, and a linearly reciprocable latitudinal cutting bar, said perforating wheel perforates said paper along a length of said paper, said latitudinal perforating bar perforates said paper along a width of said paper, said latitudinal cutting bar cuts said paper along said width of said paper;

a paper holder mounted in said frame;

a first guide roller assembly mounted between said cutting means and said paper holder, said first guide roller assembly comprising two rollers and two guide bars for directing said paper into said paper holder;

a second guide roller assembly comprised of four rollers and two guides for feeding said paper from said paper holder to an exit in said frame;

said exit in said frame comprising two rollers and an opening in said frame; and an actuating means operationally coupled to said cutting means and to said motor means, said actuating means being programmable for variable cutting and perforating patterns.

* * * * *